US006930233B2

(12) United States Patent
Hsieh

(10) Patent No.: US 6,930,233 B2
(45) Date of Patent: Aug. 16, 2005

(54) FAST RELEASE CLAMP FOR A CYMBAL

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 83 days.

(21) Appl. No.: 10/693,167

(22) Filed: Oct. 23, 2003

(65) Prior Publication Data

US 2005/0087059 A1 Apr. 28, 2005

(51) Int. Cl.[7] ..... G10D 13/02

(52) U.S. Cl. ..... 84/422.3; 84/422.2; 84/422.1

(58) Field of Search ..... 84/422.2, 422.1, 84/422.3; 224/910; 248/443, 121, 126, 127

(56) References Cited

U.S. PATENT DOCUMENTS 4,960,028 A * 10/1990 Ramirez ..... 84/421
5,936,176 A * 8/1999 Lombardi ..... 84/421
6,774,293 B2 * 8/2004 Hsieh ..... 84/327

* cited by examiner

*Primary Examiner*—Kimberly Lockett
(74) *Attorney, Agent, or Firm*—William E. Pelton, Esq.

(57) ABSTRACT

A fast release cymbal clamp includes a top pressing member with an extension extending into the assembly block and a handle pivotally connected to the assembly block such that the pivotal movement of the handle is able to force the auxiliary abutting fitting and the C-shaped clamp to engage with the outer periphery of the extension so that the cymbal extended by the extension is securely sandwiched between the upper abutting element and the lower abutting element after the handle is pivoted to engage the auxiliary abutting fitting.

8 Claims, 5 Drawing Sheets

FAST RELEASE CLAMP FOR A CYMBAL

BACKGROUND OF THE INVENTION

1. Field of the Invention

The present invention relates to a fast release clamp, and more particularly to a fast release clamp for a cymbal to enable the cymbal user to replace the cymbal in a short period of time.

2. Description of Related Art

A conventional cymbal clamp is shown in FIG. 5, wherein a cymbal (20) is supported on top of a rod (301) which is securely connected to a cymbal stand (30). The rod (301) has a free end extending out of the cymbal (20) and provided with an outer threading formed on an outer periphery of the free end of the rod (301). A nut (40) is applied to threadingly connect to the free end of the rod (301) such that the cymbal (20) is securely clamped on the rod (301). When the cymbal user is changing the cymbal for a different sound effect, the cymbal user will have to first unscrew the nut (40) and then remove the cymbal (20) from the free end of the rod (301). Thereafter, the cymbal user is able to place a new cymbal (not numbered) on top of the rod (301) and tighten the nut (40) to securely fix the cymbal on the rod (301). The process of changing the cymbal is troublesome and inefficient. Sometimes, during a concert, the band will have to use a break to allow the drummer to fix the cymbal. Therefore, it is said that the conventional structure of clamping the cymbal should be improved to allow the cymbal user (the drummer) to easily and quickly change the cymbal and thus a concert might continue without any break for replacing the cymbal.

To overcome the shortcomings, the present invention tends to provide an improved cymbal clamp to mitigate the aforementioned problems.

SUMMARY OF THE INVENTION

The primary objective of the present invention is to provide an improved clamp for a cymbal. The clamp includes a top pressing member, an assembly block and a handle. The top pressing member has an extension extending into the assembly block. The handle is pivotally connected to the assembly block and has a wedged head formed to abut an outer periphery of the extension to secure the engagement between the top pressing member and the assembly block such that the cymbal sandwiched between the upper abutting element of the top pressing member and the lower abutting element is secured and the replacement of the cymbal is able to be accomplished within a short period of time by releasing the abutment of the handle to the outer periphery of the extension and pulling the top pressing member away from the assembly block.

Another objective of the present invention is to provide an auxiliary abutting fitting is provided to the outer periphery of the extension to engage with the wedge head of the handle to further secure the engagement between the extension and the assembly block.

Other objects, advantages and novel features of the invention will become more apparent from the following detailed description when taken in conjunction with the accompanying drawings.

DETAILED DESCRIPTION OF THE PREFERRED EMBODIMENT

Figure 1:
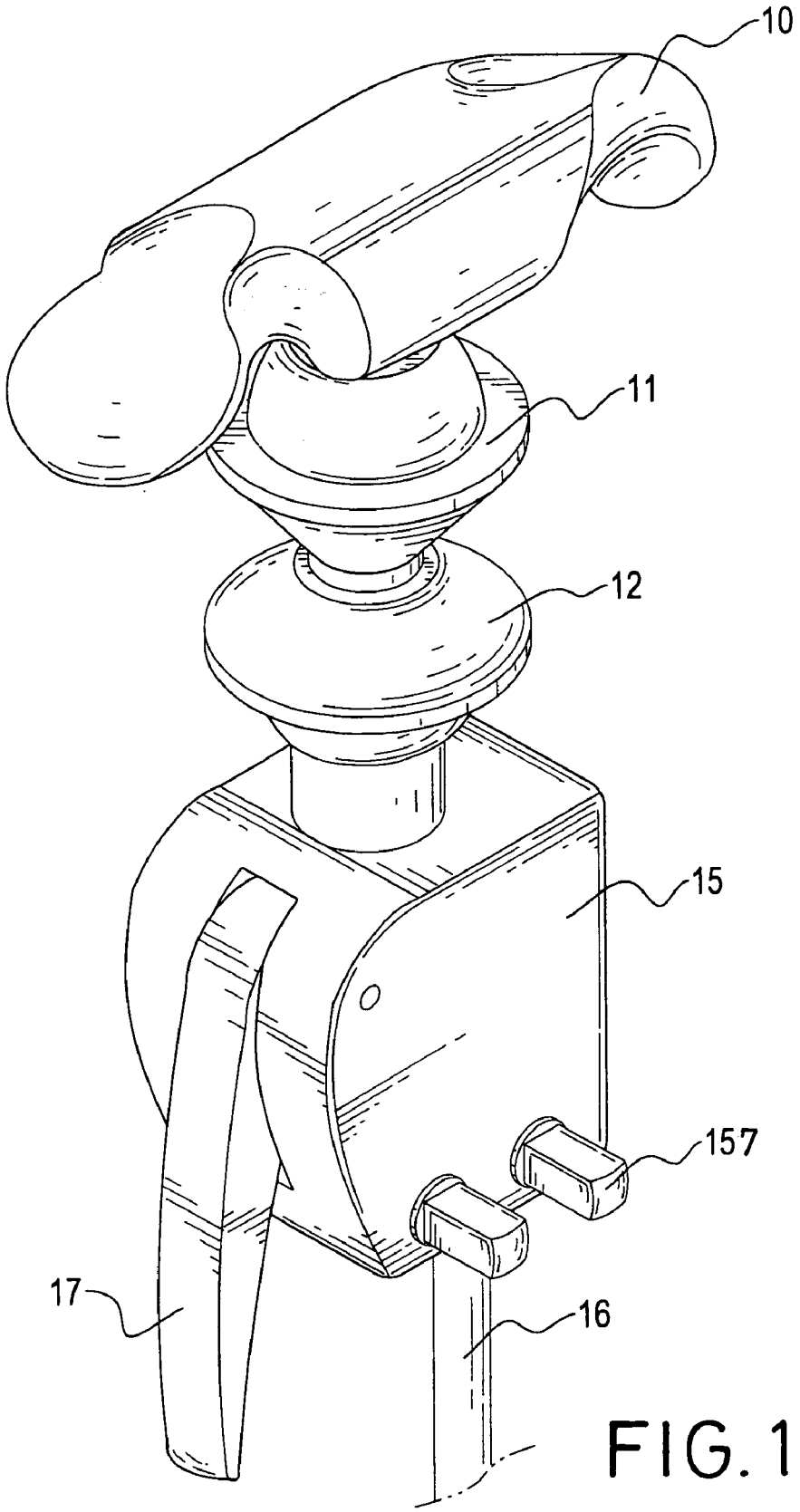
FIG. 1 is a perspective view a fast release clamp of the present invention.
Figure 2:
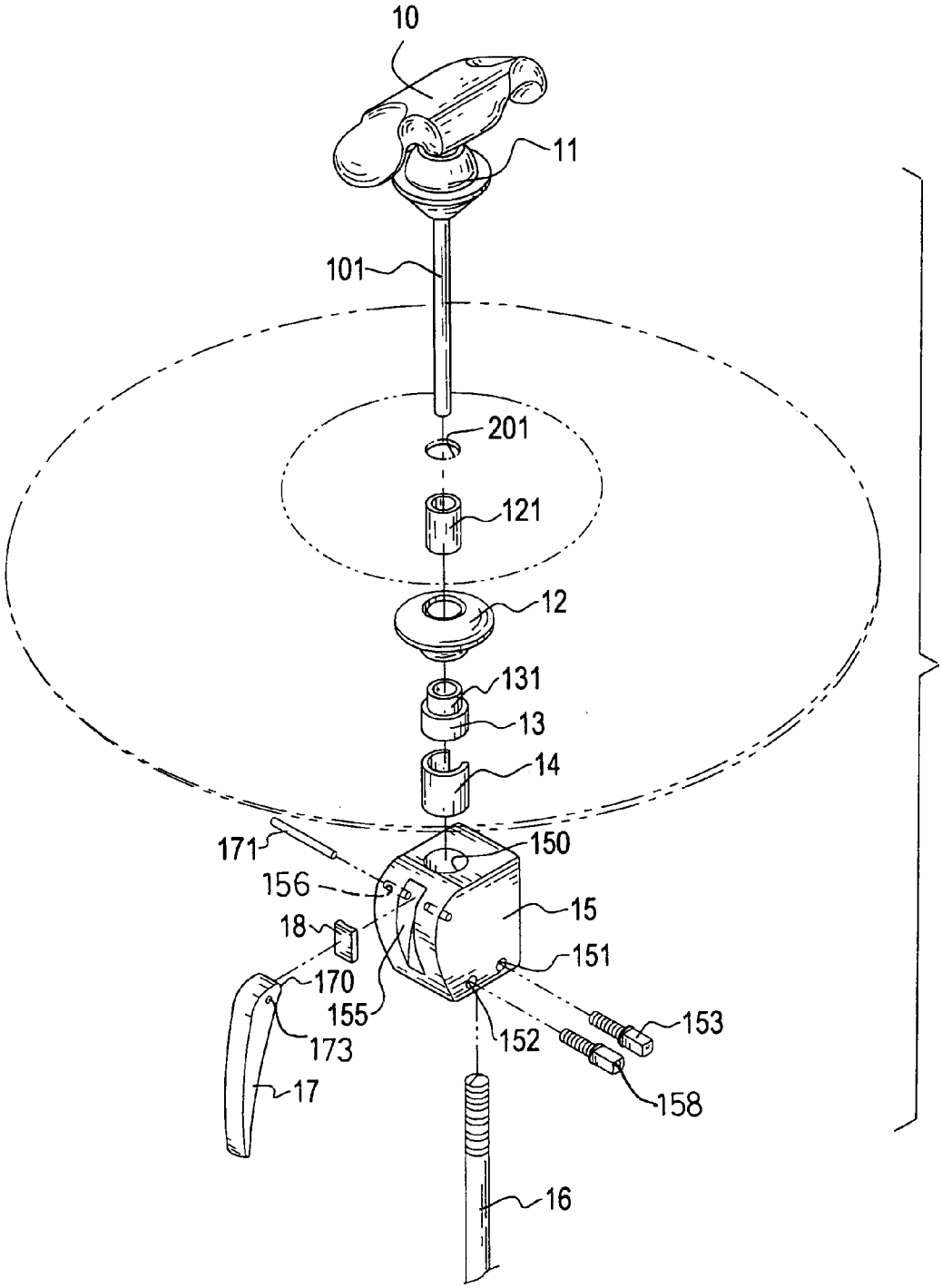
FIG. 2 is an exploded perspective view showing the elements of the clamp of the present invention.

With reference to FIGS. 1 and 2, the fast release clamp in accordance with the present invention includes a top pressing member (10), an assembly block (15) and a handle (17).

The top pressing member (10) is composed of an upper abutting element (11) integrally formed on a bottom of the top pressing member (10) and an extension (101) extending from a bottom of the upper abutting element (11). An lower abutting element (12) is separate from the upper abutting element (11) and a first sleeve (121) is sandwiched between the upper abutting element (11) and the lower abutting element (12). A second sleeve (13) is provided with a step (131) formed on a top portion of the second sleeve (13) and has a C-shaped clamp mounted around the second sleeve (13).

The assembly block (15) has a central through hole (150), a first fixing hole (151), a second fixing hole (152) both defined in a side wall of the assembly block (15), a slot (155) defined in a side wall of the assembly block (15) to communicate with the central through hole (150) and a pin hole (156) oppositely defined through the assembly block (15) to communicate with the slot (155). A supporting hole (154) is defined in the assembly block (15) for receiving therein a support (16) of a cymbal stand (not shown) and a receiving space (156) is defined in the assembly block (15) to communicate with the central through hole (150).

The handle (17) has a wedge head (170) formed on distal end of the handle (17) and a hole (173) defined in the wedge head (170) to correspond to the pin hole (156) of the assembly block (15).

Figure 3:
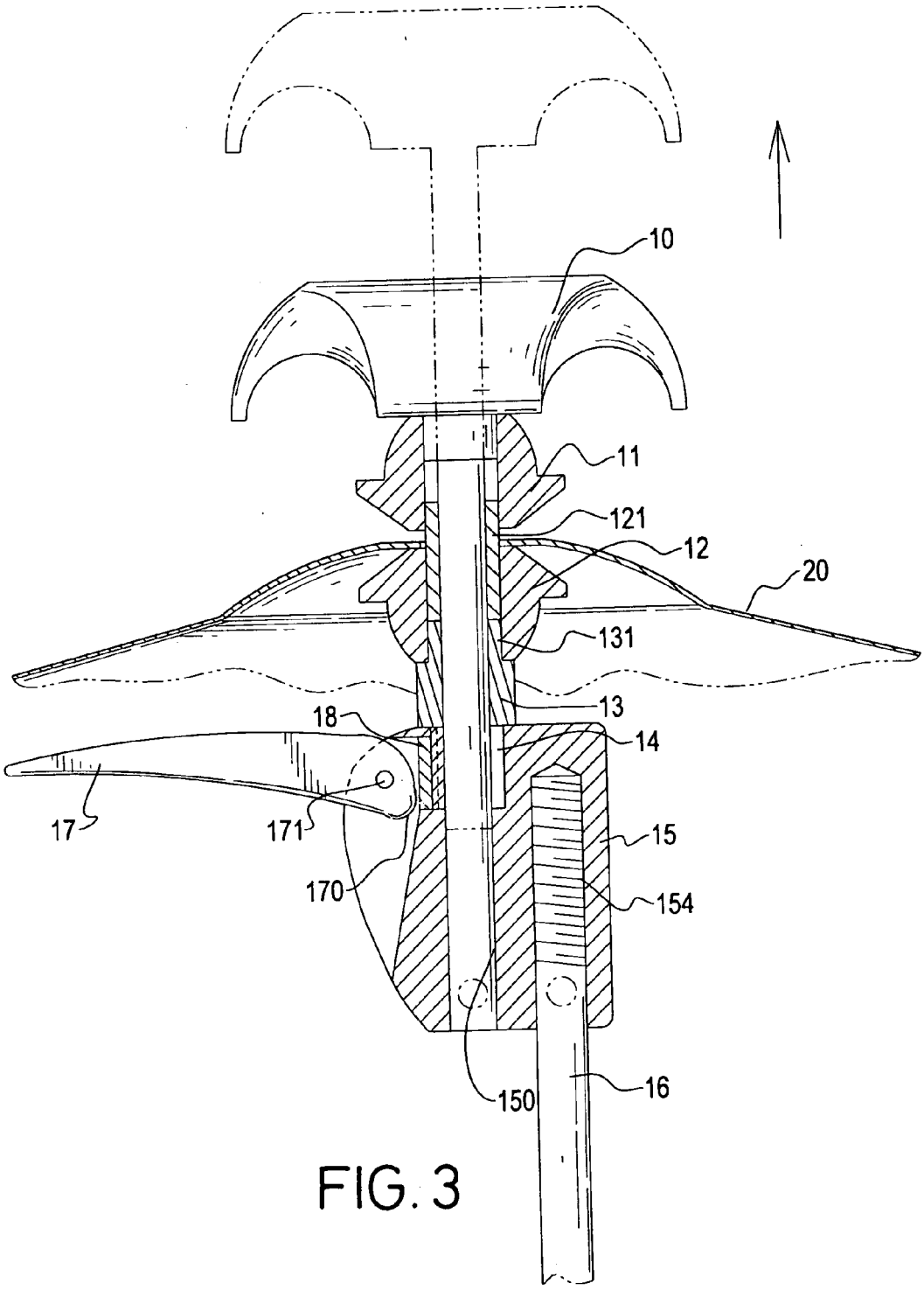
FIGS. 3 and 4 are schematic views showing the application of the clamp to a cymbal.
Figure 4:
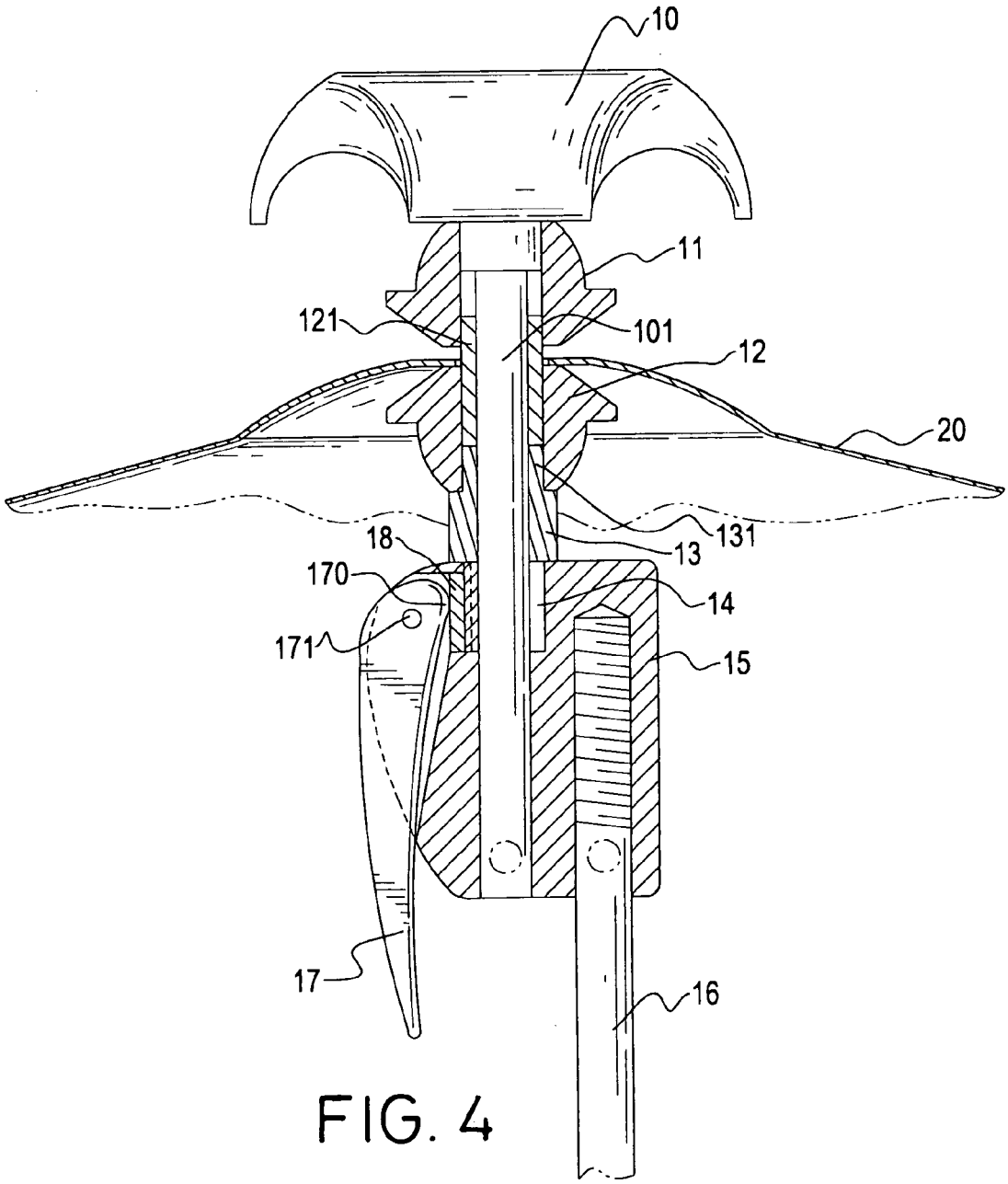
Figure 5:
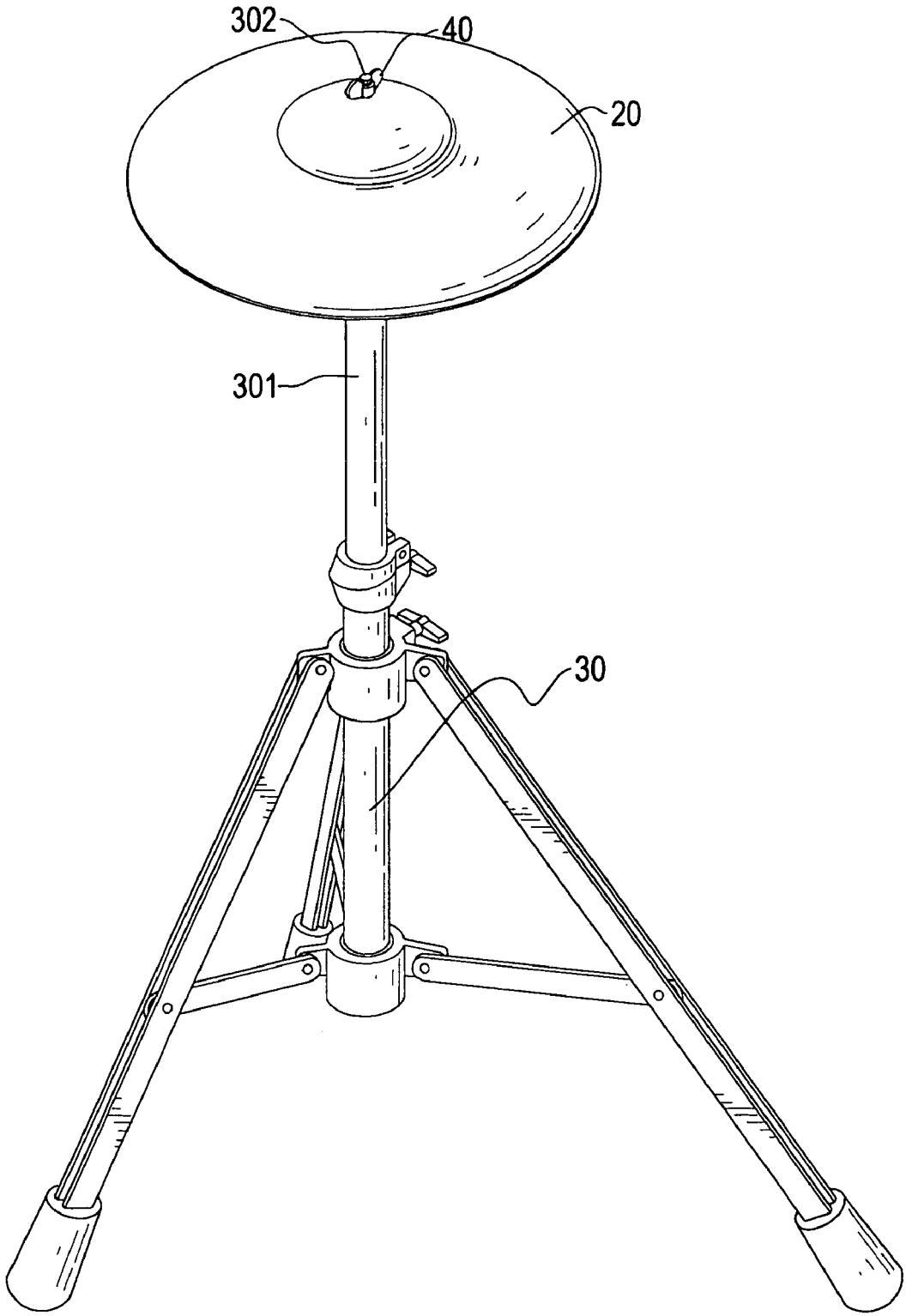
FIG. 5 PRIOR ART
FIG. 5 is a perspective view of a conventional cymbal stand.

With reference to FIGS. 3 and 4, when the clamp of the present invention is to be assembled and applied to a cymbal (20), the extension (101) of the top pressing member (10) is extended through an extension hole (201) of the cymbal (20) (as shown in FIG. 2), the first sleeve (121), the lower abutting element (12), the second sleeve (13), the C-shaped clamp (14) and into the assembly block (15) from the central through hole (150). The support (16) from the cymbal stand is threadingly extended into the supporting hole (154) of the assembly block (15). Then a first fixing element (157), such as a bolt, is threadingly extended into the first fixing hole (151) to secure the support (16) inside the supporting hole (154). A second fixing element (158), such as a bolt, is threadingly extended into the second fixing hole (152) to secure the extension (101) inside the central through hole (150). It is noted that the first sleeve (121) is sandwiched between and received in the upper abutting element (11) and the lower abutting element (12). Meanwhile, the step (131) of the second sleeve (13) is received in the lower abutting element (12) so that the lower abutting element (12) is supported by the second sleeve (13) which is securely attached to a top face of the assembly block (15). Furthermore, the C-shaped clamp (14) is received in the central through hole (150) and is extended by the extension (101).

An auxiliary abutting fitting (18) is securely received in the slot (155) to abut an outer periphery of the C-shaped clamp (14). A pin (171) is extended through the pin hole (156) of the assembly block (15) and into the hole (173) of the handle (17) to allow the handle (17) to be pivotal relative to the assembly block (15).

It is noted that because the hole (173) is eccentrically defined in the wedge head (170), when the handle (17) is pivoted, the wedge head (170) abuts a face of the auxiliary abutting fitting (18) to force the C-shaped clamp (14) to engage with an outer periphery of the extension (101) such that the extension (101) is secured inside the assembly block (15) in addition of the second fixing element (158). Thus, the assembly of the clamp of the present invention is finished.

When replacing the cymbal (20) is required, the cymbal user only needs to lifts the handle (17) to release the abutment of the wedge head (170) to the auxiliary abutting fitting (18), the resilience from the C-shaped clamp (14) will force the auxiliary abutting fitting (18) away to allow the top pressing member (10) to be movable relative to the assembly block (15). Thereafter, the cymbal user is able to lift the top pressing member (10) to proceed the replacement of the cymbal (20) in a relative short period of time and resume every element in place easily by pulling the handle (17) downward to abut the auxiliary abutting fitting (18).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fast release cymbal clamp comprising:

a top pressing member having an upper abutting element integrally formed on a bottom of the top pressing member and an extension extendable through a cymbal;

an assembly block having a central through hole to receive therein the extension and a C-shaped clamp mounted around an outer periphery of the extension, a slot defined in a side wall of the assembly block to communicate with the central through hole and a supporting hole defined in a bottom face of the assembly block for extension of a support of a cymbal stand;

a handle pivotally connected to the assembly block and received in the slot, the handle having a wedge head selectively engaged with an outer periphery of the C-shaped clamp to force the C-shaped clamp to securely clamp the outer periphery of the extension;

a lower abutting element provided underneath the upper abutting element for sandwiching the cymbal, the extension being extended through the lower abutting element; and a first sleeve having a step formed on a top portion of the first sleeve to be received in the lower abutting element to support the lower abutting element, wherein the first sleeve is securely mounted on top of the assembly block and the extension extends through the first sleeve;

thereby pivotal movement of the handle is able to selectively force the C-shaped clamp to secure engagement with the outer periphery of the extension so that the extension is secured in the assembly block and thus the cymbal is secured.

2. The clamp as claimed in claim 1, wherein the assembly block further has a first fixing hole and a second fixing hole both defined in a side wall of the assembly block, the first fixing hole communicates with the supporting hole and the second fixing hole communicates with the central through hole such that a first fixing element and a second fixing element are able to respectively extend into the first and second fixing holes and thus the support is secured in the supporting hole and the extension is secured in the central through hole.

3. The clamp as claimed in claim 1 further comprising a second sleeve sandwiched between and received in the upper abutting element and the lower abutting element.

4. The clamp as claimed in claim 2 further comprising a second sleeve sandwiched between and received in the upper abutting element and the lower abutting element.

5. A fast release cymbal clamp comprising:

a top pressing member having an upper abutting element integrally formed on a bottom of the top pressing member and an extension extendable through a cymbal;

an assembly block having a central through hole to receive therein the extension and a C-shaped clamp mounted around an outer periphery of the extension, a slot defined in a side wall of the assembly block to communicate with the central through hole, a receiving space inside the assembly block and a supporting hole defined in a bottom face of the assembly block for extension of a support of a cymbal stand;

an auxiliary abutting fitting received in the receiving space of the assembly block to engage with an outer periphery of the C-shaped clamp;

a handle pivotally connected to the assembly block and received in the slot, the handle having a wedge head selectively engaged with an outer periphery of the auxiliary abutting fitting to force the C-shaped clamp to securely clamp the outer periphery of the extension;

a lower abutting element provided underneath the upper abutting element for sandwiching the cymbal, the extension being extended through the lower abutting element; and a first sleeve having a step formed on a top portion of the first sleeve to be received in the lower abutting element to support the lower abutting element, wherein the first sleeve is securely mounted on top of the assembly block and the extension extends through the first sleeve;

thereby pivotal movement of the handle is able to selectively force the C-shaped clamp to secure engagement with the outer periphery of the extension so that the extension is secured in the assembly block and thus the cymbal is secured.

6. The clamp as claimed in claim 5, wherein the assembly block further has a first fixing hole and a second fixing hole both defined in a side wall of the assembly block, the first fixing hole communicates with the supporting hole and the second fixing hole communicates with the central through hole such that a first fixing element and a second fixing element are able to respectively extend into the first and second fixing holes and thus the support is secured in the supporting hole and the extension is secured in the central through hole.

7. The clamp as claimed in claim 5 further comprising a second sleeve sandwiched between and received in the upper abutting element and the lower abutting element.

8. The clamp as claimed in claim 6 further comprising a second sleeve sandwiched between and received in the upper abutting element and the lower abutting element.

* * * * *